US011300343B2

(12) United States Patent
Kita et al.

(10) Patent No.: US 11,300,343 B2
(45) Date of Patent: Apr. 12, 2022

(54) ICEMAKING SYSTEM AND ICEMAKING METHOD

(71) Applicant: DAIKIN INDUSTRIES, LTD., Osaka (JP)

(72) Inventors: Kouichi Kita, Osaka (JP); Azuma Kondou, Osaka (JP); Shunsuke Touya, Osaka (JP); Yuuya Seta, Osaka (JP); Shouhei Yasuda, Osaka (JP); Takeo Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/416,452

(22) PCT Filed: Sep. 26, 2019

(86) PCT No.: PCT/JP2019/037743
§ 371 (c)(1),
(2) Date: Jun. 18, 2021

(87) PCT Pub. No.: WO2020/137055
PCT Pub. Date: Jul. 2, 2020

(65) Prior Publication Data

US 2022/0042733 A1 Feb. 10, 2022

(30) Foreign Application Priority Data

Dec. 28, 2018 (JP) ..... JP2018-246580

(51) Int. Cl.
*F25C 1/145* (2018.01)
*F25C 1/147* (2018.01)

(52) U.S. Cl.
CPC ..... *F25C 1/145* (2013.01); *F25C 1/147* (2013.01); *F25C 2301/002* (2013.01); *F25C 2600/04* (2013.01)

(58) Field of Classification Search
CPC .... F25C 1/145; F25C 1/147; F25C 2301/002; F25C 2600/04
See application file for complete search history.

(56) References Cited

U.S. PATENT DOCUMENTS 3,650,121 A * 3/1972 Kimpel ..... F25C 1/147 62/136
2015/0096310 A1 4/2015 Wait et al.
2018/0335239 A1* 11/2018 Zhou ..... F25C 5/182

FOREIGN PATENT DOCUMENTS

JP 3-204575 A 9/1991
JP 04263763 A * 9/1992
(Continued)

OTHER PUBLICATIONS

International Preliminary Report of corresponding PCT Application No. PCT/JP2019/037743 dated Jul. 8, 2021.
(Continued)

*Primary Examiner* — Joseph F Trpisovsky
(74) *Attorney, Agent, or Firm* — Global IP Counselors, LLP

(57) ABSTRACT

An icemaking system includes a circulation circuit configured to circulate icemaking solution, at least one icemaker provided in the circulation circuit, a cooling mechanism, a first detector and an adjuster. The icemaker includes a cooling chamber and a scraping mechanism. The cooling chamber has an inflow port and an exhaust port of solution, and the cooling chamber allows the solution to flow in the cooling chamber. The scraping mechanism scrapes ice generated on an inner surface of the cooling chamber. The cooling mechanism cools the solution in the cooling chamber. The first detector detects whether the inflow port of the cooling chamber has an ice nucleus. The adjuster adjusts a
(Continued)

cooling temperature of the solution in accordance with a detection result of the first detector.

13 Claims, 6 Drawing Sheets

(56) References Cited

FOREIGN PATENT DOCUMENTS

| | | |
|---|---|---|
| JP | 2003-148841 A | 5/2003 |
| JP | 2017-101849 A | 6/2017 |

OTHER PUBLICATIONS

International Search Report of corresponding PCT Application No. PCT/JP2019/037743 dated Nov. 12, 2019.
European Search Report of corresponding EP Application No. 19 90 2432.4 dated Jan. 31, 2022.

* cited by examiner

ICEMAKING SYSTEM AND ICEMAKING METHOD

CROSS-REFERENCE TO RELATED APPLICATIONS

This U.S. National stage application claims priority under 35 U.S.C. § 119(a) to Japanese Patent Application No. 2018-246580, filed in Japan on Dec. 28, 2018, the entire contents of which are hereby incorporated herein by reference.

BACKGROUND

Field of the Invention

The present disclosure relates to an icemaking system and an icemaking method.

Background Information

There has been known an icemaking system including a plurality of icemakers each having a cooling chamber through which an icemaking solution flows, a refrigerant chamber through which a refrigerant flows, and configured to cause heat exchange between the solution in the cooling chamber and the refrigerant in the refrigerant chamber for icemaking (see Japanese Unexamined Patent Publication No. 3-204575 and the like). In the icemaking system according to Patent Literature 1, the cooling chambers in the plurality of icemakers are connected in series via icemaking solution pipe and the refrigerant chambers in the plurality of icemakers are connected in parallel via gas side branch pipes and liquid side branch pipes. Furthermore, the gas side branch pipes are connected to a suction side of a compressor, the liquid side branch pipes are connected to a refrigerant exhaust end of a condenser, and a refrigerant inflow end of the condenser is connected to a discharge side of the compressor.

SUMMARY

An icemaking system typically comes into a subcooling state where solution temperature in an icemaker is less than freezing temperature from operation start to actual ice generation in the icemaker. When the icemaker is out of the subcooling state, the solution temperature reaches the freezing temperature and icemaking starts.

The icemaker includes a cooling chamber provided therein with a rotary blade configured to scrape ice sticking to an inner surface of the cooling chamber. When the solution is out of the subcooling state and ice is rapidly generated on an inner surface of an icemaking chamber, the rotary blade may be caught by the ice to receive an overload (hereinafter, such a phenomenon will also be called "ice lock"). The ice lock is more likely to occur as the icemaker has lower cooling temperature of the solution (evaporation temperature of a refrigerant). The icemaking system thus executes icemaking only at certain cooling temperature causing no ice lock.

It is an object of the present disclosure to provide an icemaking system and an icemaking method that enable adjustment of cooling temperature according to a state of solution in an icemaker for efficient icemaking.

(1) An icemaking system according to the present disclosure includes:

a circulation circuit configured to circulate icemaking solution;

an icemaker including a cooling chamber having an inflow port and an exhaust port of solution and allowing the solution to flow therein, and a scraping mechanism configured to scrape ice generated on an inner surface of the cooling chamber, the icemaker provided in the circulation circuit;

a cooling mechanism configured to cool the solution in the cooling chamber;

a first detector configured to detect whether or not the inflow port of the cooling chamber has ice nucleus; and an adjuster configured to adjust cooling temperature of the solution in accordance with a detection result of the first detector.

It is known that a lower limit of the cooling temperature (ice lock critical temperature), which generates no ice lock at the scraping mechanism in the cooling chamber, varies depending on whether or not there is ice nucleus flowing into the cooling chamber. Specifically, the lower limit of the cooling temperature is lower in a case where there is ice nucleus flowing into the cooling chamber rather than a case where there is no ice nucleus flowing into the cooling chamber. In the icemaking system thus configured, the first detector detects whether or not the inflow port of the cooling chamber has ice nucleus, and the adjuster adjusts the cooling temperature of the solution in accordance with the detection result. When the first detector detects ice nucleus flowing into the cooling chamber, the cooling temperature can thus be decreased within a range not causing ice lock for higher icemaking performance and efficient icemaking.

(2) Preferably, the circulation circuit includes a plurality of the icemakers disposed in series, the first detector detects whether or not the inflow port of the cooling chamber has ice nucleus in each of the icemakers, and the adjuster controls the cooling mechanism in accordance with the detection result of the first detector, and individually adjusts cooling temperature of the solution in the cooling chamber in each of the icemakers.

Such a configuration achieves detection as to whether or not there is ice nucleus flowing into the cooling chamber in each of the icemakers and adjustment of the cooling temperature for each of the icemakers, for efficient improvement in icemaking performance of each of the icemakers.

(3) Preferably, the cooling mechanism includes plural systems of refrigerant circuits correspondingly to the plurality of icemakers, each of the refrigerant circuits individually supplies, by means of a vapor compression refrigeration cycle, a corresponding one of the icemakers with a refrigerant, and each of the refrigerant circuits is provided with a compressor of a variable capacity type controlled by the adjuster.

In this configuration, the adjuster controls the capacity of the compressor in each of the refrigerant circuits to achieve adjustment of evaporation temperature (i.e. cooling temperature) of the refrigerant supplied to each of the icemakers.

(4) Preferably, the cooling mechanism includes a single system of refrigerant circuit parallelly connecting the plurality of icemakers, the refrigerant circuit supplies, by means of a vapor compression refrigeration cycle, the plurality of icemakers with a refrigerant, and the refrigerant circuit includes a flow rate control valve controlled by the adjuster and configured to control a flow rate of a gas refrigerant passing at least the icemaker disposed upstream in a solution flowing direction to be evaporated, and a compressor configured to suck the gas refrigerant having passed the flow rate control valve.

In this configuration, the adjuster controls the flow rate control valve to achieve adjustment of the flow rate of the gas refrigerant passing each of the icemakers, and individual adjustment of the evaporation temperature (i.e. cooling temperature) of the refrigerant supplied to each of the icemakers.

(5) Preferably, the first detector sets, as a condition for having ice nucleus, that temperature of solution at the inflow port of the cooling chamber is less than zero degrees and has variation less than a predetermined value for a certain period.

In this configuration, the first detector can detect whether or not there is ice nucleus flowing into the cooling chamber.

(6) Preferably, the first detector further sets, as a condition for having ice nucleus, that solution at the inflow port and solution at the exhaust port of the cooling chamber have temperature difference less than a predetermined value for a certain period.

In this configuration, the first detector can more accurately detect whether or not there is ice nucleus flowing into the cooling chamber.

(7) Preferably, the icemaking system further includes a second detector configured to detect subcooling elimination at the exhaust port of the cooling chamber, and the first detector further sets, as a condition for having ice nucleus, elapse of a certain period after detection of subcooling elimination by the second detector.

This configuration also includes the second detector for more accurate detection as to whether or not there is ice nucleus flowing into the cooling chamber.

(8) Preferably, the second detector sets, as a condition for subcooling elimination, that temperature of solution at the exhaust port of the cooling chamber is less than zero degrees and has variation less than a predetermined value for a certain period.

In this configuration, the second detector can detect a subcooling state adjacent to the exhaust port of the cooling chamber.

(9) An icemaking method according to the present disclosure is a method of icemaking by cooling solution circulating in a circulation circuit in a cooling chamber of an icemaker, the method including:

detecting whether or not an inflow port of the cooling chamber has ice nucleus; and controlling cooling temperature of solution in the cooling chamber in accordance with whether or not there is ice nucleus.

DETAILED DESCRIPTION OF EMBODIMENT(S)

Embodiments of the present disclosure will be described in detail hereinafter with reference to the drawings.

First Embodiment

[Entire Configuration of Icemaking System]

Figure 1:
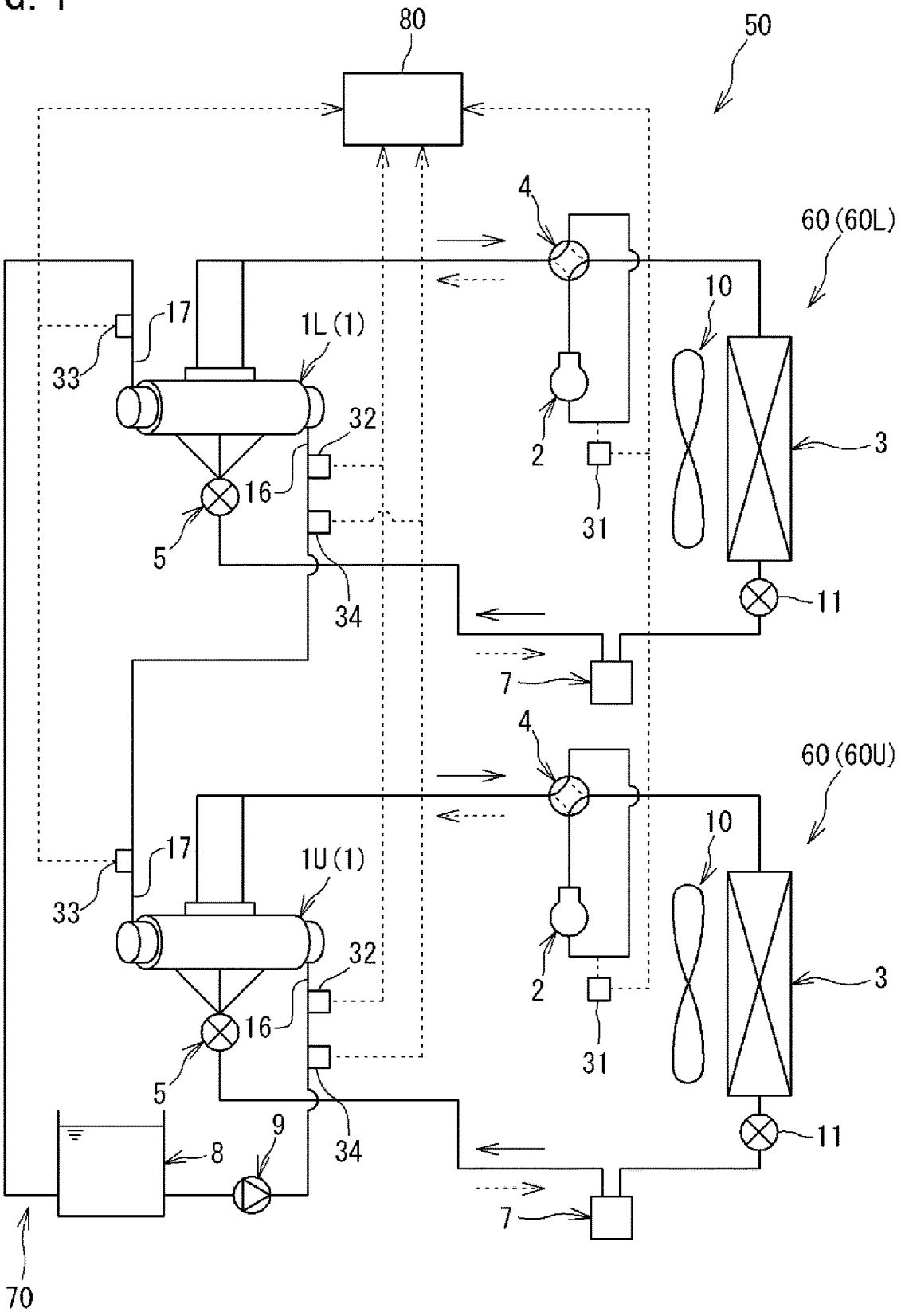
FIG. 1 is a schematic configuration diagram of an icemaking system according to a first embodiment.

FIG. 1 is a schematic configuration diagram of an icemaking system according to the first embodiment.

The present embodiment provides an icemaking system 50 including icemakers (ice generators) 1U and 1L configured to continuously generate ice slurry from seawater (icemaking solution) as a raw material stored in a seawater tank 8, and returns the generated ice slurry into the seawater tank 8.

The icemakers 1U and 1L according to the present embodiment may be each configured as a double pipe icemaker. The icemaking system 50 according to the present embodiment includes a plurality of (two depicted exemplarily) icemakers 1U and 1L.

In the present embodiment, the plurality of icemakers will be generally denoted by reference sign "1" and will be distinguished and denoted by reference signs "1U" and "1L". The same applies to a "refrigerant circuit".

Ice slurry is sherbet ice produced by mixing water or aqueous solution with minute ice. Ice slurry may also be called icy slurry, slurry ice, slush ice, or liquid ice.

The icemaking system 50 according to the present embodiment is configured to continuously generate ice slurry from seawater. The icemaking system 50 according to the present embodiment is thus placed on a fishing boat, at a fishing port, or the like, and ice slurry returned to the seawater tank 8 is used to cool fresh fish or the like.

As depicted in FIG. 1, the icemaking system 50 includes a refrigerant circuit 60 configured to achieve a vapor compression refrigeration cycle, and a circulation circuit 70 configured to circulate seawater as a cooling target between the seawater tank 8 and the icemakers 1U and 1L. The icemaking system 50 according to the present embodiment includes a plural systems of refrigerant circuits 60U and 60L correspondingly to the plurality of icemakers 1U and 1L. The refrigerant circuits 60U and 60L each function as a cooling mechanism configured to cool seawater in the icemaker 1.

The icemaking system 50 further includes a controller 80 configured to control operation of devices included in the icemaking system 50.

[Configuration of Refrigerant Circuit 60]

The refrigerant circuits 60 each include the icemaker 1, a compressor 2, a heat source heat exchanger 3, a four-way switching valve 4, a first expansion valve 5, a second expansion valve 11, a receiver 7, and the like. The refrigerant circuit 60 includes these devices connected via refrigerant pipes.

The icemaker 1 functions as a utilization heat exchanger of the refrigerant circuit 60.

The compressor 2 compresses a refrigerant and circulates the refrigerant in the refrigerant circuit 60. The compressor 2 according to the present embodiment is of a variable capacity type (performance variable type). Specifically, the compressor 2 includes a build-in motor that is inverter controlled for stepwise or continuous change in operating frequency. Control of the operating frequency of the compressor 2 achieves adjustment of evaporation temperature of the refrigerant supplied to the icemaker 1.

The four-way switching valve 4 is connected to a discharge side of the compressor 2. The four-way switching valve 4 has a function of switching a flow of the refrigerant discharged from the compressor 2 to either the heat source heat exchanger 3 or the icemaker 1. The four-way switching valve 4 switches between icemaking operation and thawing operation.

The first expansion valve 5 functions as a utilization expansion valve and is constituted by an electronic expansion valve having an adjustable opening degree according to a control signal. The second expansion valve 11 functions as a heat source expansion valve and is constituted by an electronic expansion valve having an adjustable opening degree according to a control signal.

There is provided a fan 10 configured to air cool the heat source heat exchanger 3. The fan 10 includes a motor configured to stepwise or continuously change a number of operating revolutions through inverter control.

[Configuration of Circulation Circuit 70]

The circulation circuit 70 includes the icemaker 1, the seawater tank 8, a pump 9, and the like. The circulation circuit 70 includes these devices connected via seawater pipes.

The pump 9 sucks seawater from the seawater tank 8 and pressure feeds the seawater to a cooling chamber 12 in the icemaker 1. Ice slurry generated in the cooling chamber 12 is returned to the seawater tank 8 along with seawater due to pump pressure.

The plurality of icemakers 1U and 1L in the circulation circuit 70 is connected in series via the seawater pipe. Seawater pressure fed from the pump 9 is thus supplied to the icemaker 1U disposed upstream in a flow direction of the seawater and then to the icemaker 1L disposed downstream, and is thereafter returned to the seawater tank 8. The seawater supplied to each of the icemakers 1U and 1L is cooled to be discharged from each of the icemakers 1U and 1L in the form of ice slurry.

[Configuration of Icemaker 1]

Figure 2:
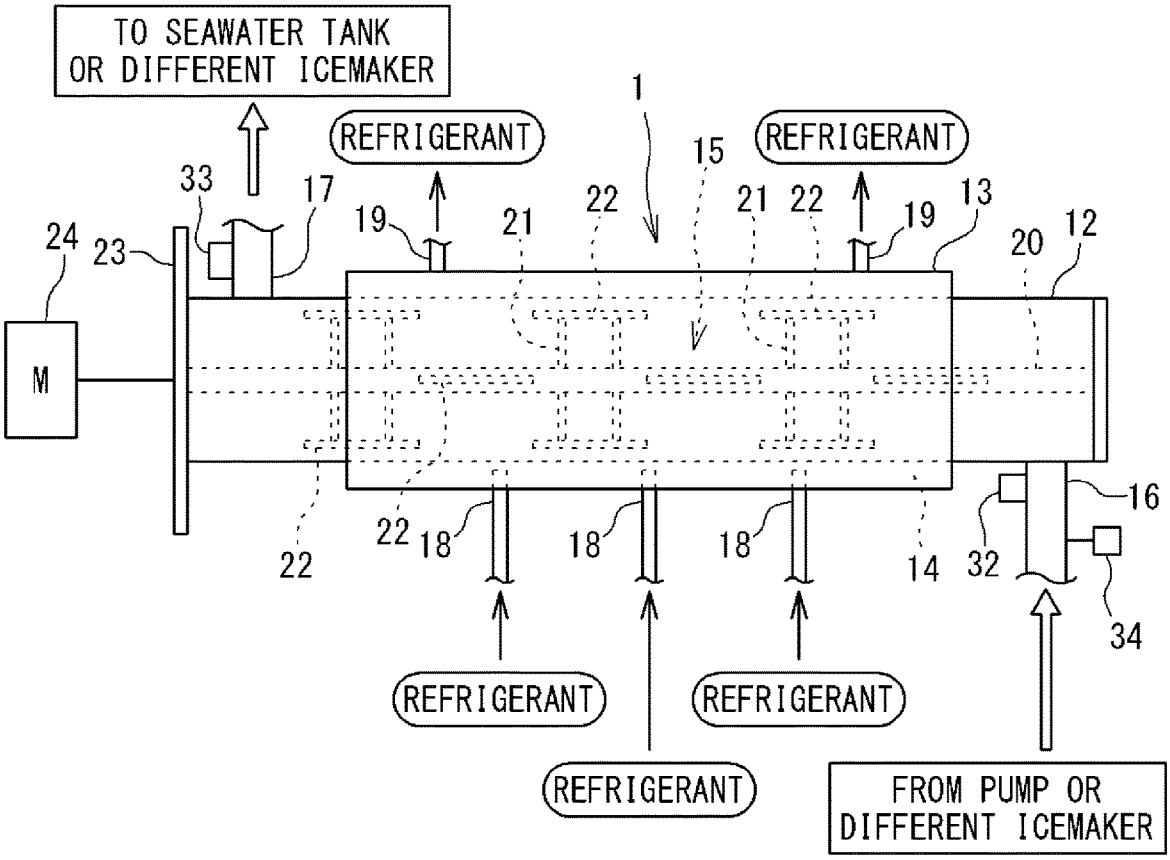
FIG. 2 is an explanatory side view of an icemaker.
Figure 3:
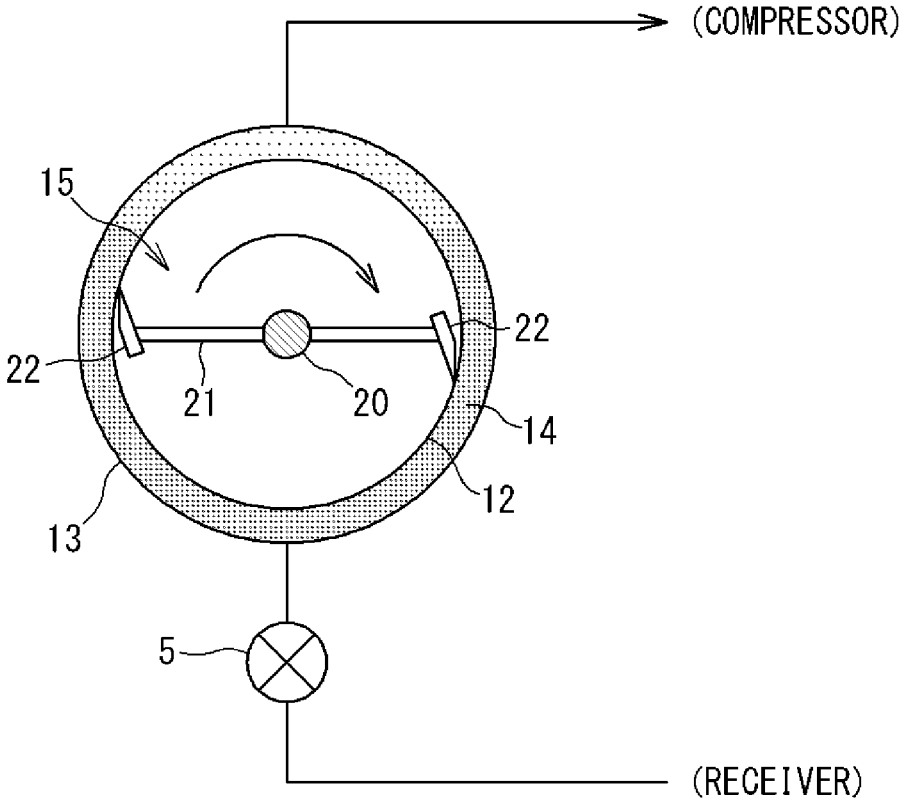
FIG. 3 is an explanatory view schematically depicting a transverse section of the icemaker.

FIG. 2 is an explanatory side view of the icemaker. FIG. 3 is an explanatory view schematically depicting a transverse section of the icemaker.

The icemaker 1 according to the present embodiment is configured as a double pipe icemaker. The icemaker 1 includes an inner pipe 12 and an outer pipe 13 each having a cylindrical shape, and a scraping mechanism 15. The inner pipe 12 is smaller in outer diameter than the outer pipe 13, and is disposed in the outer pipe 13 concentrically with the outer pipe 13. The inner pipe 12 projects from the outer pipe 13 in both axial directions. The icemaker 1 according to the present embodiment is of a horizontal type, and the inner pipe 12 and the outer pipe 13 are disposed axially horizontally.

The inner pipe 12 is an element having an interior allowing seawater as a cooling target medium to flow and pass therethrough. The inner pipe 12 constitutes a "cooling chamber" configured to cool seawater. The inner pipe 12 has an "inner circumferential surface" constituting an "inner surface" of the cooling chamber. The inner pipe 12 is made of a metal material. The inner pipe 12 has axial ends both closed.

The inner pipe 12 has a first axial end (a right end in FIG. 2) provided with an inflow port 16 for seawater. Seawater is supplied through the inflow port 16 into the inner pipe 12. The inner pipe 12 has a second axial end (a left end in FIG. 2) provided with an exhaust port 17 for seawater. Seawater in the inner pipe 12 is discharged from the exhaust port 17.

The inner pipe 12 is provided with the scraping mechanism 15. The scraping mechanism 15 scrapes ice generated on the inner circumferential surface of the inner pipe 12 and disperses the scraped ice in the inner pipe 12.

The scraping mechanism 15 according to the present embodiment is configured as a blade mechanism including scraping blades 22. The blade mechanism 15 includes the blades 22, as well as a shaft 20, support bars 21, and a driver 24. The shaft 20 is disposed concentrically with the inner pipe 12 and is rotatably supported in the inner pipe 12. The shaft 20 projects outward from a flange 23 provided at the first axial end of the inner pipe 12, and is connected to a motor 24 functioning as the driver.

The support bars 21 are each made of a rod member projecting radially outward from an outer circumferential surface of the shaft 20. The support bars 21 are disposed at predetermined axial intervals along the shaft 20. The blades 22 are each fixed to a distal end of a corresponding one of the support bars 21. The blades 22 are each made of a resin or metal band plate member or the like. The blades 22 each have a side edge positioned ahead in a rotation direction and tapered sharp.

The outer pipe 13 is provided radially outside the inner pipe 12 and concentrically with the inner pipe 12. The outer pipe 13 is made of a metal material. The outer pipe 13 has a lower portion provided with one or a plurality of (three in the present embodiment) refrigerant inlets 18. The outer pipe 13 has an upper portion provided with one or a plurality of (two in the present embodiment) refrigerant outlets 19. There is an annular space 14 that is provided between an inner circumferential surface of the outer pipe 13 and an outer circumferential surface of the inner pipe 12, and is a region serving as a refrigerant chamber receiving the refrigerant exchanging heat with seawater. The refrigerant supplied from the refrigerant inlet 18 passes the annular space 14 and is discharged from the refrigerant outlet 19.

[Configuration of Controller 80]

As depicted in FIG. 1, the icemaking system 50 includes the controller 80. The controller 80 includes a CPU and a memory. The memory includes a RAM, a ROM, a flash memory, and the like.

The controller 80 causes the CPU to execute a computer program stored in the memory, to achieve various control relevant to operation of the icemaking system 50.

Specifically, the controller 80 controls opening degrees of the utilization expansion valve 5 and the heat source expansion valve 11. The controller 80 further controls operating frequencies of the compressor 2 and the fan 10. The controller 80 also controls operation of the driver 24 in the blade mechanism 15 and the pump 9. The controller 80 may alternatively be provided divisionally for the icemaker 1 and the heat source heat exchanger 3. Exemplarily in this case, a controller for the heat source heat exchanger 3 can control operation of the heat source expansion valve 11, the fan 10, and the compressor 2, and a controller for the icemaker 1 can control operation of the utilization expansion valve 5, the driver 24, and the pump 9.

As to be described later, the controller 80 also functions as a detector (second detector) configured to detect subcooling elimination in the inner pipe 12, a detector (first detector) configured to detect whether or not there is ice nucleus in the inner pipe 12, or a constituent element of an adjuster configured to control the operating frequency of the compressor 2 and adjust the evaporation temperature.

The icemaking system 50 includes a plurality of sensors. Specifically, as depicted in FIG. 1, the compressor 2 includes a refrigerant suction pipe provided with a pressure sensor 31 configured to detect refrigerant pressure. The inflow port 16 of the inner pipe 12 in each of the icemakers 1 is provided with a temperature sensor 32 configured to detect temperature of seawater (and ice slurry) and a concentration sensor 34 configured to measure salinity of seawater. The exhaust port 17 of the inner pipe 12 in each of the icemakers 1 is provided with a temperature sensor 33 configured to detect temperature of seawater (and ice slurry). The temperature sensor 32 and the concentration sensor 34 provided at the inflow port 16 have detection values substantially equal to temperature and concentration of seawater flowing into the inner pipe 12. The temperature sensor 33 provided at the exhaust port 17 has a detection value substantially equal to temperature of seawater discharged from the inner pipe 12.

The pressure sensor 31, the temperature sensors 32 and 33, and the concentration sensor 34 have detection signals to be received by the controller 80 and be utilized for various control. The present embodiment particularly adopts the detection signals of the sensors for control of cooling temperature of seawater (evaporation temperature of the refrigerant) in the icemaker 1.

[Operation of Icemaking System 50]

(Icemaking Operation)

The four-way switching valve 4 in each of the refrigerant circuits 60 is kept in a state indicated by solid lines in FIG. 1 during icemaking operation. The compressor 2 discharges a gas refrigerant that has high temperature and high pressure, the gas refrigerant flows into the heat source heat exchanger 3 functioning as a condenser via the four-way switching valve 4 and exchanges heat with air supplied from the fan 10 to be condensed and liquefied. The liquefied refrigerant passes the heat source expansion valve 11 fully opened, and flows to the utilization expansion valve 5 via the receiver 7.

The refrigerant is decompressed to have predetermined low pressure by the utilization expansion valve 5 and become a refrigerant in a gas-liquid two-phase state, and is supplied from the refrigerant inlet 18 of the icemaker 1 (see FIG. 2) into the annular space (refrigerant chamber) 14 between the inner pipe 12 and the outer pipe 13 constituting the icemaker 1. The refrigerant supplied into the annular space 14 exchanges heat with seawater flowing into the inner pipe 12 by means of the pump 9 to be evaporated. In this case, the refrigerant has saturation temperature (evaporation temperature) equal to cooling temperature for cooling of seawater. The refrigerant evaporated in the icemaker 1 is sucked into the compressor 2.

The pump 9 sucks seawater from the tank 8 and pressure feeds the seawater into the inner pipe 12 in each of the icemakers 1. When the seawater is cooled in the inner pipe 12, there are generated ice particles on and adjacent to an inner surface of the inner pipe 12. The ice particles thus generated are scraped by the blade mechanism 15 and are mixed with seawater to form ice slurry in the inner pipe 12. The ice slurry thus generated is discharged from the exhaust port 17 of the inner pipe 12 and is returned to the seawater tank 8 due to pump pressure. The ice slurry returned to the tank 8 is raised by buoyancy in the tank 8 to be accumulated in an upper portion of the tank 8.

(Thawing Operation)

Icemaking operation described above may cause ice solidified and sticking to the inner circumferential surface of the inner pipe 12 and increase a rotation load of the blades 22 caught by the ice in the blade mechanism 15 (such a phenomenon will also be called "ice lock"). The inner pipe 12 may be provided therein with accumulated ice slurry and seawater may have a slow flow in the inner pipe 12 (such a phenomenon will also be called "ice accumulation"). These phenomena lead to difficulty in continuous operation of the icemaker 1, and thawing operation is thus executed to thaw ice in the inner pipe 12.

Upon detection of ice lock or ice accumulation described above, the controller 80 switches the four-way switching valve 4 in each of the refrigerant circuits 60 into a state indicated by dotted lines in FIG. 1. The compressor 2 discharges the gas refrigerant that have high temperature, the gas refrigerant flows into the annular space 14 between the inner pipe 12 and the outer pipe 13 of the icemaker 1 via the four-way switching valve 4, and exchanges heat with seawater containing ice in the inner pipe 12 to be condensed and liquefied. The ice in the inner pipe 12 is heated by the refrigerant and thawed in this case. A liquid refrigerant discharged from the icemaker 1 passes the utilization expansion valve 5 fully opened, and flows into the heat source expansion valve 11 via the receiver 7. The liquid refrigerant is decompressed by the heat source expansion valve 11, is then evaporated in the heat source heat exchanger 3, and is sucked into the compressor 2.

[Evaporation Temperature Adjustment Depending on Whether or not there is Ice Nucleus]

When the icemaking system 50 starts for icemaking operation as described above, the tank 8 contains no ice just after the start and seawater in the tank 8 has temperature more than freezing temperature of seawater. The seawater in the tank 8 is sent to each of the icemakers 1 by the pump 9 and is cooled to gradually decrease in temperature. Typically, seawater does not form ice immediately after reaching the freezing temperature and comes into a subcooling state having temperature less than the freezing temperature. Ice starts to be generated upon subcooling elimination of seawater. Ice is rapidly generated on the inner surface of the inner pipe 12 due to latent heat upon subcooling elimination of seawater, in which case ice lock described above is likely to occur.

Furthermore, likelihood of ice lock is dependent on whether or not the inner pipe 12 is provided therein with ice particles called ice nucleus. In a case where there is no ice nucleus in the inner pipe 12, seawater comes into the subcooling state having temperature less than the freezing temperature as described above and ice lock is likely to occur upon elimination of the subcooling state. In another case where there is ice nucleus in the inner pipe 12, seawater is not subcooled and is decreased in temperature to reach the freezing temperature to allow ice generation.

Figure 4:
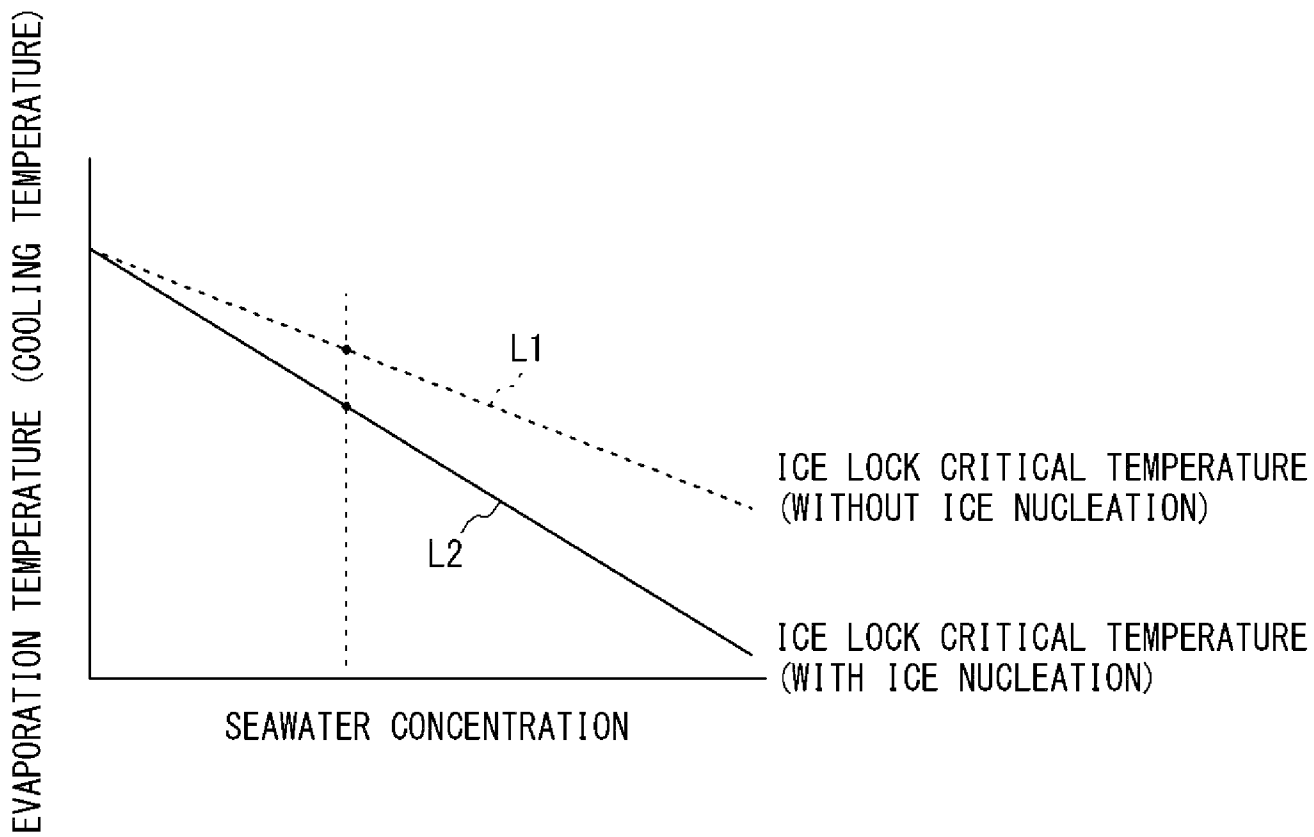
FIG. 4 is a graph indicating a lower limit of evaporation temperature not causing ice lock in relation to concentration of seawater.

FIG. 4 is a graph indicating a lower limit (ice lock critical temperature) of evaporation temperature (cooling temperature) not causing ice lock in relation to concentration of seawater. FIG. 4 includes line L1 indicating ice lock critical temperature for the case where there is no ice nucleus in the inner pipe 12, and line L2 indicating ice lock critical temperature for the case where there is ice nucleus in the inner pipe 12. Ice lock critical temperature is higher in the case where there is no ice nucleus in the inner pipe 12 rather than the case where there is ice nucleus in the inner pipe 12 regardless of seawater concentration. Ice lock is unlikely to occur when there is ice nucleus in the inner pipe 12. The evaporation temperature is thus further decreased to promote ice generation. Ice lock is more likely to occur without increase in evaporation temperature when there is no ice nucleus in the inner pipe 12 rather than the case where there is ice nucleus in the inner pipe 12. The evaporation temperature accordingly needs to be further increased and icemaking takes time.

The icemaking system 50 according to the present embodiment detects whether or not there is ice nucleus in the inner pipe 12 in each of the icemakers 1. The evaporation temperature is increased to prevent ice lock when there is no ice nucleus whereas the evaporation temperature is decreased to promote ice generation when there is ice nucleus, for efficient icemaking in the entire icemaking system 50.

Specific control will be described below.

During icemaking operation of the icemaking system 50 according to the present embodiment, the controller 80 executes two-step processing described in (a) and (b) below.

(a) Detection of subcooling elimination at the exhaust port 17 of the inner pipe 12

Figure 5:
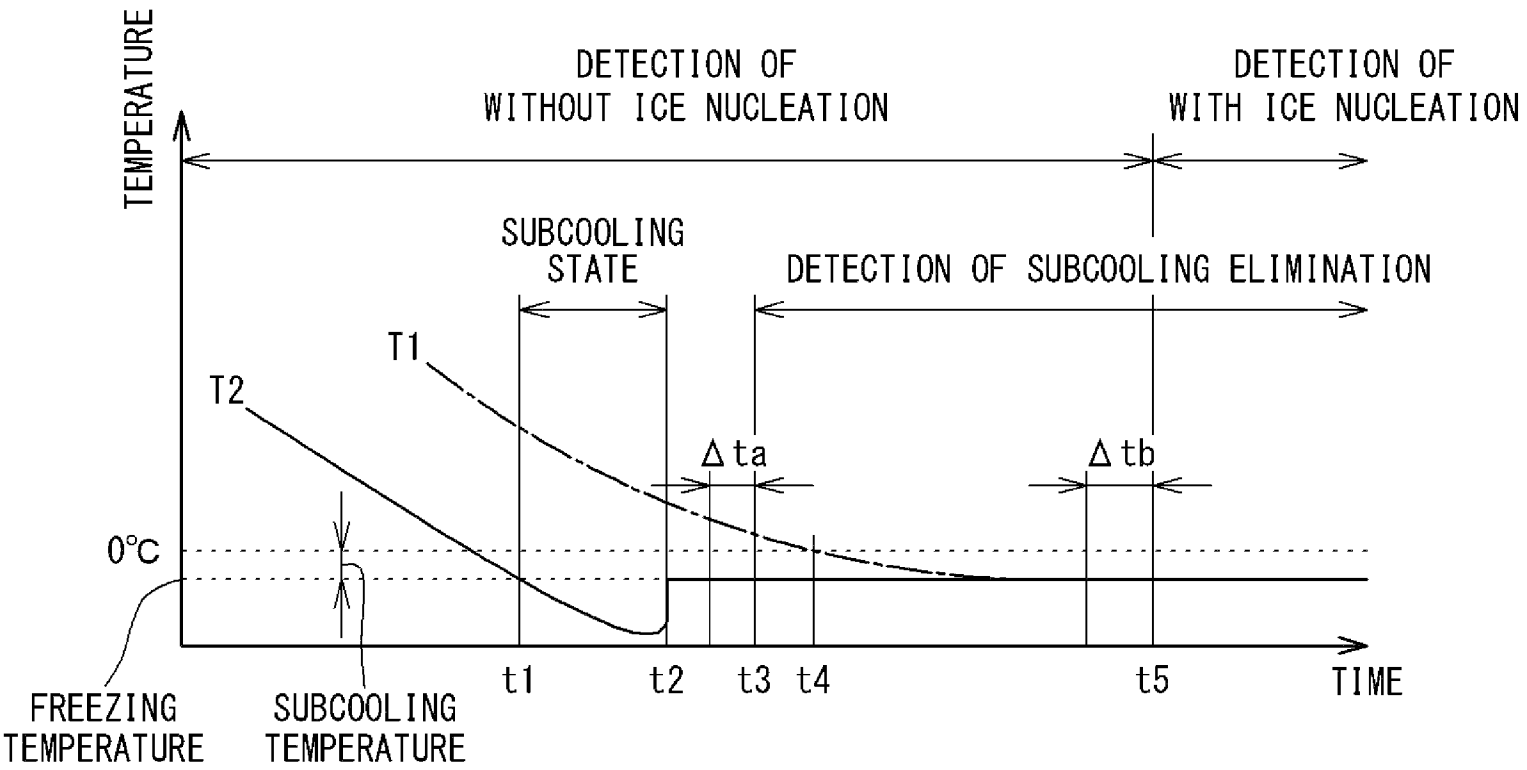
FIG. 5 is a graph indicating temperature change of seawater at an inflow port and an exhaust port of an inner pipe.

(b) detection as to whether or not the inflow port 16 of the inner pipe 12 has ice nucleus FIG. 5 is a graph indicating temperature change of seawater at the inflow port and the exhaust port of the inner pipe.

When the icemaking system 50 starts icemaking operation, seawater flowing from the inflow port 16 into the inner pipe 12 is gradually decreased in temperature as approaching the exhaust port 17. Seawater at the exhaust port 17 of the inner pipe 12 is thus lower in temperature than seawater at the inflow port 16. Seawater discharged from the inner pipe 12 in the icemaker 1U disposed upstream flows into the inner pipe 12 of the icemaker 1L disposed downstream while being substantially kept in temperature.

As indicated in FIG. 5, temperature T2 at the exhaust port 17 of the inner pipe 12 in each of the icemakers 1 gradually decreases as time elapses, and reaches the freezing temperature at time t1 and then comes into the subcooling state. Meanwhile, temperature T1 at the inflow port 16 of the inner pipe 12 gradually decreases to after decrease of the temperature T2 at the exhaust port 17. The temperature T2 at the exhaust port 17 of the inner pipe 12 increases to reach the freezing temperature at time t2 when subcooling is eliminated. Ice generation thus starts in the inner pipe 12.

In order to detect reliable subcooling elimination during the above processing (a), the controller 80 according to the present embodiment determines subcooling elimination at time t3 when seawater increases in temperature to reach the freezing temperature and be stabilized. At the inflow port 16 of the inner pipe 12, the temperature T1 of seawater gradually approaches the freezing temperature to be stabilized. The controller 80 accordingly determines that there is ice nucleus at time t5 when seawater reaches the freezing temperature and is stabilized during the above processing (b).

Detection of subcooling elimination during the processing (a) is achieved when the controller 80 determines whether or not conditions 1 to 3 below are satisfied.

(Condition 1) The icemaking system 50 has an operation period equal to or longer than a predetermined period (Condition 2) Seawater at the exhaust port 17 of each of the inner pipes 12 has temperature kept to be less than 0° C. for a certain period (Condition 3) Seawater at the exhaust port 17 of each of the inner pipes 12 has temperature with variation less than a predetermined value for a certain period Detection as to whether or not there is ice nucleus during the processing (b) is achieved when the controller 80 determines whether or not conditions 4 to 7 below are satisfied.

(Condition 4) Seawater at the inflow port 16 of each of the inner pipes 12 has temperature kept to be less than 0° C. for a certain period (Condition 5) Seawater at the inflow port 16 of each of the inner pipes 12 has temperature with variation less than a predetermined value for a certain period (Condition 6) Seawater at the inflow port 16 and seawater at the exhaust port 17 of each of the inner pipes 12 have temperature difference kept to be less than a predetermined value for a certain period (Condition 7) A certain period has elapsed after subcooling elimination at the exhaust port 17 of each of the inner pipes 12

As to each of the above conditions, the temperature T1 at the inflow port 16 of each of the inner pipes 12 is detected by the temperature sensor 32 depicted in FIG. 1. The temperature T2 at the exhaust port 17 of each of the inner pipes 12 is detected by the temperature sensor 33. These temperature sensors 32 and 33 each serve as a constituent element of the detector (second detector) configured to detect subcooling elimination or the detector (first detector) configured to detect whether or not there is ice nucleus.

(Detection of Subcooling Elimination)

The controller 80 determines, as the "condition 1" for detection of subcooling elimination in the processing (a), whether or not at least the predetermined period has elapsed after the icemaking system 50 starts operation. The temperature of seawater in the inner pipe 12 decreases and subcooling is eliminated through the subcooling state only after elapse of a certain period. The operation period in the condition 1 can be exemplified by 20 minutes.

The controller 80 determines, as the "condition 2" for detection of subcooling elimination, whether or not the temperature T2 of seawater at the exhaust port 17 of each of the inner pipes 12 is less than 0° C. for the certain period. The temperature T2 of seawater may temporarily reach 0° C. while being decreasing after operation start, and is constantly less than 0° C. from the subcooling state to the freezing temperature reached after subcooling elimination. The certain period in the condition 2 can be exemplified by 15 minutes of continuation of temperature less than 0° C.

The controller 80 determines, as the "condition 3", whether or not the temperature T2 of seawater at the exhaust port 17 of each of the inner pipes 12 has variation less than the predetermined value for the certain period. When the temperature T2 increases from the subcooling state to reach the freezing temperature at the time t2 as indicated in FIG. 5, the subcooling state can be provisionally regarded as being eliminated. However, the temperature sensor 33 may have malfunction or erroneous detection due to any other factor. The present embodiment thus sets the condition 3 for reliable detection of subcooling elimination. Specifically assuming that current temperature of seawater at the current exhaust port 17 is denoted by T2 and temperature at earlier time by a predetermined period (e.g. 15 minutes earlier) is denoted by T2', determined is whether or not the state described by the following expression (1) lasts for a certain period (Δta in FIG. 5; 15 minutes or the like).

$$|T2-T2'|<\alpha \quad (1)$$

The expression (1) sets a condition that variation between the current temperature T2 and the temperature T2' at earlier time by the predetermined period is continuously less than a predetermined value α for the certain period. The predetermined value α can be exemplarily set to 0.4° C. The expression (1) thus sets the condition that the temperature T2 of seawater is stable with substantially no change.

The controller 80 detects subcooling elimination at the exhaust port 17 of the inner pipe 12 when the conditions 1 to 3 are satisfied.

(Detection as to Whether or Not There is Ice Nucleus)

The controller 80 determines, as the "condition 4" for detection as to whether or not there is ice nucleus in the processing (b), that the temperature T1 at the inflow port 16 of each of the inner pipes 12 is less than 0° C. for the certain period (e.g. 15 minutes). When seawater at the inflow port 16 has temperature equal to or more than 0° C., the inflow port 16 is extremely unlikely to have ice nucleus.

The controller 80 determines, as the "condition 5" for detection as to whether or not there is ice nucleus, that the temperature T1 of seawater at the inflow port 16 of each of the inner pipes 12 has variation less than the predetermined value for the certain period. As indicated in FIG. 5, the temperature T1 of seawater at the inflow port 16 becomes less than 0° C. at time t4, and then keeps decreasing to reach the freezing temperature. When the temperature T1 is continuously at the freezing temperature for a certain period, the controller 80 can determine that the inflow port 16 has ice nucleus and ice generation is executed. Assuming that current temperature of seawater at the current inflow port 16 is denoted by T1 and temperature at earlier time by a predetermined period (e.g. 15 minutes earlier) is denoted by T1', the condition (5) relates to determination as to whether or not the state described by the following expression (2) lasts for a certain period (Δtb in FIG. 5; 15 minutes or the like).

$$|T1-T1'|<\beta \quad (2)$$

The expression (2) indicates that variation between the current temperature T1 and the temperature T1' at earlier time by the predetermined period is less than a predetermined value β. The predetermined value β can be exemplarily set to 0.4° C. The expression (2) thus sets the condition that the temperature T1 of seawater is stable with substantially no change.

The controller 80 determines, as the "condition 6" for detection as to whether or not there is ice nucleus, that the refrigerant at the inflow port 16 and the refrigerant at the exhaust port 17 of each of the inner pipes 12 have temperature difference less than the predetermined value for the certain period. As indicated in FIG. 5, the temperature T1 of seawater at the inflow port 16 stabilized at around the freezing temperature has less difference with the temperature T2 of seawater at the exhaust port 17. The condition 5 thus relates to comparison between the temperature T1 of seawater at the inflow port 16 and the temperature T2 of seawater at the exhaust port 17, and determination as to whether or not the state described by the following expression (3) lasts for a certain period (Δtb in FIG. 5; 15 minutes or the like).

$$|T1-T2|<\gamma \quad (3)$$

The expression (3) indicates that the temperature T1 at the inflow port 16 and the temperature T2 at the exhaust port 17 have difference less than a predetermined value γ. The predetermined value γ can be exemplarily set to 0.4° C. The expression (3) thus sets the condition that the temperature of seawater in the entire inner pipe 12 is substantially constant.

The controller 80 determines, as the "condition 7" for detection as to whether or not there is ice nucleus, that the certain period (e.g. 15 minutes) has elapsed after subcooling elimination at the exhaust port 17 of each of the inner pipes 12. Subcooling elimination at the exhaust port 17 of each of the inner pipes 12 is detected through determination of the conditions 1 to 3.

The controller 80 detects that the inflow port 16 of the inner pipe 12 has ice nucleus when the conditions 4 to 7 are satisfied.

[Evaporation Temperature Adjustment]

When detecting that the inflow port 16 of the inner pipe 12 in the icemaker 1 has ice nucleus through the above processing, the controller 80 controls the compressor 2 in the refrigerant circuit 60 provided with the icemaker 1 to adjust the evaporation temperature of the refrigerant. Specifically, the controller 80 sets target evaporation temperature with the ice lock critical temperature L2 indicated in FIG. 4 as a lower limit, in accordance with concentration (concentration detected by the concentration sensor 34) of seawater flowing into the icemaker 1. The controller 80 then controls the operating frequency of the compressor 2 in the refrigerant circuit 60 provided with the icemaker 1 such that the evaporation temperature of the refrigerant reaches the target evaporation temperature. The controller 80 exemplarily controls the operating frequency of the compressor 2 such that low pressure detected by the pressure sensor 31 reaches target evaporation pressure associated with the target evaporation temperature. This promotes ice generation for efficient icemaking.

The icemaking system 50 according to the present embodiment includes the plurality of icemakers 1U and 1L, and the plurality of refrigerant circuits 60U and 60L provided correspondingly to the icemakers 1U and 1L, and is configured to detect whether or not there is ice nucleus for each of the icemakers 1U and 1L and control the evaporation temperature of the refrigerant in each of the refrigerant circuits 60U and 60L corresponding to the icemakers 1U and 1L in accordance with detection results.

In each of the icemakers 1U and 1L, seawater flowing from the inflow port 16 into the inner pipe 12 is gradually decreased in temperature while flowing toward the exhaust port 17. The exhaust port 17 thus has lower temperature than the inflow port 16, the exhaust port 17 having the lower temperature initially comes into the subcooling state and subcooling is initially eliminated at the exhaust port 17 for icemaking start. When the exhaust port 17 has subcooling elimination and ice nucleus is generated in the icemaker 1U disposed upstream, the ice nucleus is discharged from the exhaust port 17 and readily flows into the inner pipe 12 of the icemaker 1L disposed downstream. In the icemaker 1L disposed downstream, the inflow port 16 of the inner pipe 12 thus has ice nucleus at a relatively early stage. In contrast, ice nucleus generated at the exhaust port 17 in the icemaker 1L disposed downstream is discharged from the exhaust port 17 and is then returned to the tank 8. It accordingly takes time until the ice nucleus thereafter flows from the tank 8 into the inner pipe 12 in the icemaker 1U disposed upstream. Typically, the icemaker 1 disposed downstream thus initially has ice nucleus at the inflow port 16 of the inner pipe 12, the evaporation temperature of the refrigerant supplied to the icemaker 1 is controlled to be decreased for promotion of ice generation.

Second Embodiment

Figure 6:
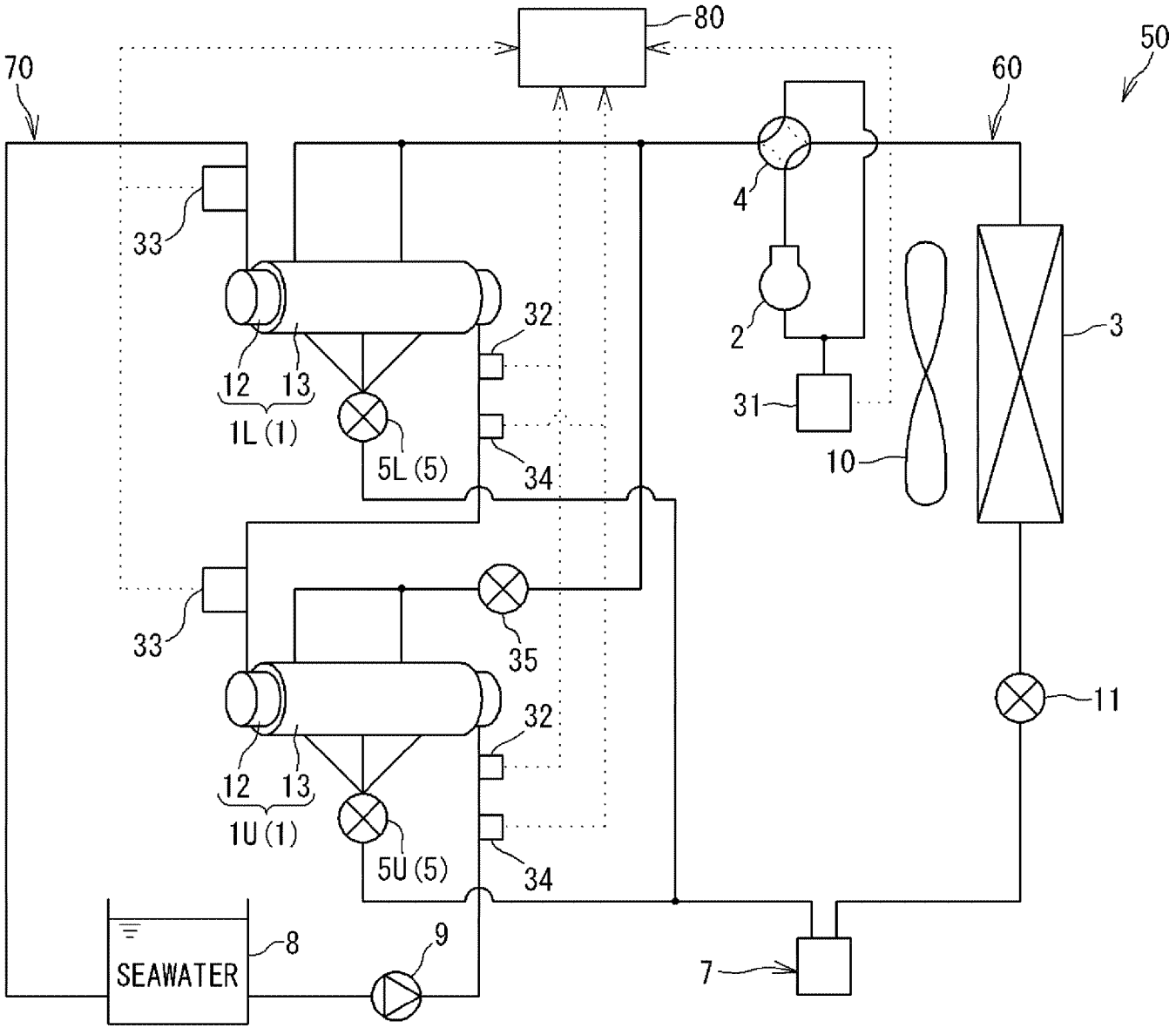
FIG. 6 is a schematic configuration diagram of an icemaking system according to a second embodiment.

FIG. 6 is a schematic configuration diagram of an icemaking system according to the second embodiment.

The icemaking system 50 according to the present embodiment is similar to that according to the first embodiment in that the icemaking system includes the plurality of icemakers 1, but includes, in place of the plurality of refrigerant circuits 60 corresponding to the plurality of icemakers 1, a single system refrigerant circuit 60 corresponding to the plurality of icemakers 1. This refrigerant circuit 60 includes the plurality of icemakers 1 connected in parallel, and expansion valves 5U and 5L correspondingly to the icemakers 1. The refrigerant pipe between the icemaker 1U disposed upstream and the four-way switching valve 4 is provided with a flow rate control valve 35 configured to control a flow rate of a gas refrigerant discharged from the icemaker 1U.

As in the first embodiment, the controller 80 according to the present embodiment executes detection of subcooling elimination at the exhaust port 17 of the inner pipe 12 in each of the icemakers 1, and detection as to whether or not the inflow port 16 of the inner pipe 12 has ice nucleus. When ice nucleus is initially detected in the icemaker 1L disposed downstream, the controller 80 controls the operating frequency of the compressor 2 to decrease the evaporation temperature of the refrigerant.

The icemaker 1L disposed downstream has ice nucleus and can thus promote ice generation without ice lock even upon decrease in evaporation temperature. Meanwhile, the icemaker 1U disposed upstream has no ice nucleus and is thus likely to have ice lock upon decrease in evaporation temperature. The controller 80 according to the present embodiment thus controls to close the flow rate control valve 35 so as to decrease the flow rate of the gas refrigerant discharged from the icemaker 1U disposed upstream, increases the evaporation pressure of the refrigerant in the icemaker 1U, and adjusts so as not to decrease the evaporation temperature. The icemaker 1U disposed upstream can thus execute icemaking operation at rather high evaporation temperature causing no ice lock.

The icemaking system 50 according to the second embodiment may alternatively include a flow rate control valve configured to control a flow rate of a gas refrigerant discharged from the icemaker 1L disposed downstream, and may adjust, with use of the flow rate control valve, evaporation temperature of a refrigerant supplied to the icemaker 1L disposed downstream.

Other Embodiments

The above embodiments each include determination of the conditions 4 to 7 for detection as to where or not the inflow port 16 of the inner pipe 12 in the icemaker 1 has ice nucleus. Each of these embodiments may alternatively adopt only one or a plurality of conditions out of the conditions 4 to 7. For example, only the conditions 4 and 5 can be adopted for detection as to whether or not there is ice nucleus. Each of the embodiments may adopt the condition 6 or the condition 7 in addition to the conditions 4 and 5. The above embodiments each include determination of the conditions 1 to 3 for detection of subcooling elimination at the exhaust port 17 of the inner pipe 12 in the icemaker 1. Each of these embodiments may alternatively adopt only the conditions 1 and 2 or the like.

The above embodiments each exemplify the icemaker 1 configured as a "horizontal" double pipe icemaker. The icemaker 1 may alternatively be configured as a "vertical" or "gradient" double pipe icemaker.

The above embodiments each exemplify the icemaking system 50 including the two icemakers 1. The icemaking system 50 may alternatively include only one icemaker or three or more icemakers.

The above embodiments each exemplify the icemaking system 50 adopting "seawater" as the solution serving as a cooling target. The cooling target should not be limited to seawater, but can be other solution such as ethylene glycol.

The scraping mechanism 15 according to each of the above embodiments is provided as the blade mechanism including the blades 22 configured to rotate about the inner pipe 12. The scraping mechanism 15 may alternatively be of a different type, such as an auger scraping mechanism including a screw.

The embodiments provide the predetermined values $\alpha$, $\beta$, and $\gamma$ exemplified by 0.4° C. and included in expressions (1) to (3) for detection of subcooling elimination or detection as to whether or not there is ice nucleus. These predetermined values should not be limited to this case but can be changed where appropriate.

<Functional Effects of Embodiments>

(1) An icemaking system 50 according to each of the above embodiments includes: a circulation circuit 70 configured to circulate icemaking solution (seawater); an icemaker 1 including a cooling chamber (inner pipe) 12 having an inflow port 16 and an exhaust port 17 of solution and allowing the solution to flow therein, and a scraping mechanism (blade mechanism) 15 configured to scrape ice generated on an inner surface of the cooling chamber 12, the icemaker 1 provided in the circulation circuit 70; a cooling mechanism (refrigerant circuit) 60 configured to cool the seawater in the cooling chamber 12; a first detector (a temperature sensor 32 or 33, and a controller 80) configured to detect whether or not the inflow port 16 of the cooling chamber (inner pipe) 12 has ice nucleus; and an adjuster (the controller 80) configured to adjust cooling temperature of the seawater (evaporation temperature of a refrigerant) in accordance with a detection result of the first detector.

In the icemaking system 50 thus configured, the first detector detects whether or not the inflow port 16 of the cooling chamber 12 has ice nucleus, and the adjuster controls the cooling mechanism 60 to adjust the cooling temperature of the solution in accordance with the detection result. When the first detector detects ice nucleus flowing into the cooling chamber 12, the cooling temperature can thus be decreased within a range not causing ice lock for higher icemaking performance and efficient icemaking.

(2) According to each of the above embodiments, the circulation circuit 70 includes a plurality of the icemakers 1U and 1L disposed in series, the first detector detects whether or not the inflow port 16 of the cooling chamber 12 has ice nucleus in each of the icemakers 1U and 1L, and the adjuster controls the cooling mechanism 60 in accordance with the detection result of the first detector, and individually adjusts cooling temperature of the solution in the cooling chamber 12 in each of the icemakers 1U and 1L.

This configuration achieves detection as to whether or not there is ice nucleus flowing into the cooling chamber 12 in each of the icemakers 1U and 1L and adjustment of the cooling temperature for each of the icemakers 1U and 1L, for efficient improvement in icemaking performance of each of the icemakers 1U and 1L.

(3) According to the first embodiment, the cooling mechanism 60 includes a plural systems of refrigerant circuits 60U and 60L correspondingly to the plurality of icemakers 1U and 1L, each of the refrigerant circuits 60U and 60L individually supplies, by means of a vapor compression refrigeration cycle, a corresponding one of the icemakers 1U and 1L with a refrigerant, and each of the refrigerant circuits 60U and 60L is provided with a compressor 2 of a variable capacity type controlled by the adjuster.

In this configuration, the adjuster controls the capacity of the compressor 2 in each of the refrigerant circuits 60U and 60L to achieve adjustment of the evaporation temperature (i.e. cooling temperature) of the refrigerant supplied to each of the icemakers 1U and 1L.

(4) According to the second embodiment, the cooling mechanism 60 includes a single system of refrigerant circuit 60 parallelly connecting the plurality of icemakers 1U and 1L, the refrigerant circuit supplies, by means of a vapor compression refrigeration cycle, the plurality of icemakers 1U and 1L with a refrigerant, and the refrigerant circuit 60 includes a flow rate control valve 35 controlled by the adjuster and configured to control a flow rate of a gas refrigerant passing at least the icemaker 1U disposed upstream in a solution flowing direction to be evaporated, and a compressor 2 configured to suck the gas refrigerant having passed the flow rate control valve 35.

In this configuration, the adjuster controls the flow rate control valve 35 to achieve adjustment of the flow rate of the gas refrigerant passing at least the icemaker 1U disposed upstream and adjustment of the evaporation temperature (i.e. cooling temperature) of the refrigerant supplied to the icemaker 1U.

(5) According to each of the embodiments, the first detector sets, as a condition for having ice nucleus, that temperature of solution at the inflow port 16 of the cooling chamber 12 is less than zero degrees and has variation less than a predetermined value for a certain period. The first detector can thus detect whether or not there is ice nucleus flowing into the cooling chamber 12.

(6) According to each of the embodiments, the first detector further sets, as a condition for having ice nucleus, that solution at the inflow port 16 and solution at the exhaust port 17 of the cooling chamber 12 have temperature difference less than a predetermined value for a certain period.

The first detector can thus more accurately detect whether or not there is ice nucleus flowing into the cooling chamber 12.

(7) According to each of the embodiments, the icemaking system 50 further includes a second detector (the temperature sensor 33 and the controller 80) configured to detect subcooling elimination at the exhaust port 17 of the cooling chamber 12, and the first detector further sets, as a condition for having ice nucleus, detection of subcooling elimination by the second detector.

This configuration also adopts the second detector for more accurate detection as to whether or not there is ice nucleus flowing into the cooling chamber 12.

(8) According to each of the embodiments, the second detector sets, as a condition for subcooling elimination, that temperature of solution at the exhaust port 17 of the cooling chamber 12 is less than zero degrees and has variation less than a predetermined value for a certain period.

The second detector can thus detect subcooling elimination at the exhaust port 17 of the cooling chamber 12.

The embodiments disclosed herein should be exemplary in terms of every aspect and should not be restrictive. The present disclosure includes any modification recited by claims within meanings and a scope equivalent to those recited in the claims.

What is claimed is:

1. An icemaking system comprising:

a circulation circuit configured to circulate icemaking solution;

at least one icemaker provided in the circulation circuit, the at least one icemaker including a cooling chamber having an inflow port and an exhaust port of solution, the cooling chamber allowing the solution to flow therein, and a scraping mechanism configured to scrape ice generated on an inner surface of the cooling chamber;

a cooling mechanism configured to cool the solution in the cooling chamber;

a first detector configured to detect whether the inflow port of the cooling chamber has an ice nucleus; and an adjuster configured to adjust a cooling temperature of the solution in accordance with a detection result of the first detector.

2. The icemaking system according to claim 1, wherein the at least one icemaker includes a plurality of icemakers disposed in series in the circulation circuit, the first detector is configured to detect whether the inflow port of the cooling chamber has an ice nucleus in each of the icemakers, and the adjuster is configured to control the cooling mechanism in accordance with the detection result of the first detector, and individually adjust the cooling temperature of the solution in the cooling chamber in each of the icemakers.

3. The icemaking system according to claim 2, wherein the cooling mechanism includes plural systems of refrigerant circuits corresponding to the plurality of icemakers, each of the refrigerant circuits individually supplies, using a vapor compression refrigeration cycle, a corresponding one of the icemakers with a refrigerant, and each of the refrigerant circuits is provided with a compressor of a variable capacity controlled by the adjuster.

4. The icemaking system according to claim 2, wherein the cooling mechanism includes a single system of refrigerant circuit parallelly connecting the plurality of icemakers, the refrigerant circuit supplies, using a vapor compression refrigeration cycle, the plurality of icemakers with a refrigerant, and the refrigerant circuit includes a flow rate control valve controlled by the adjuster, the flow rate control valve being configured to control a flow rate of a gas refrigerant passing at least the icemaker disposed upstream in a solution flowing direction to be evaporated, and a compressor configured to suck the gas refrigerant having passed the flow rate control valve.

5. The icemaking system according to claim 1, wherein the first detector is configured to set, as a condition for having the ice nucleus, that the temperature of solution at the inflow port of the cooling chamber is less than zero degrees and has variation less than a predetermined value for a certain period.

6. The icemaking system according to claim 5, wherein the first detector is configured to set, as a condition for having the ice nucleus, that solution at the inflow port and solution at the exhaust port of the cooling chamber have temperature difference less than a predetermined value for a certain period.

7. The icemaking system according to claim 5, further comprising:

a second detector configured to detect subcooling elimination at the exhaust port of the cooling chamber, the first detector being further configured to set, as a condition for having the ice nucleus, elapse of a certain period after detection of subcooling elimination by the second detector.

8. The icemaking system according to claim 7, wherein the second detector is configured to set, as a condition for subcooling elimination, that temperature of solution at the exhaust port of the cooling chamber
is less than zero degrees and
has variation less than a predetermined value for a certain period.

9. The icemaking system according to claim 2, wherein the first detector is configured to set, as a condition for having the ice nucleus, that the temperature of solution at the inflow port of the cooling chamber
is less than zero degrees and
has variation less than a predetermined value for a certain period.

10. The icemaking system according to claim 3, wherein the first detector is configured to set, as a condition for having the ice nucleus, that the temperature of solution at the inflow port of the cooling chamber
is less than zero degrees and
has variation less than a predetermined value for a certain period.

11. The icemaking system according to claim 4, wherein the first detector is configured to set, as a condition for having the ice nucleus, that the temperature of solution at the inflow port of the cooling chamber
is less than zero degrees and
has variation less than a predetermined value for a certain period.

12. The icemaking system according to claim 6, further comprising:
a second detector configured to detect subcooling elimination at the exhaust port of the cooling chamber,
the first detector being further configured to set, as a condition for having the ice nucleus, elapse of a certain period after detection of subcooling elimination by the second detector.

13. A method of icemaking by cooling solution circulating in a circulation circuit in a cooling chamber of an icemaker, the icemaking method comprising:
detecting whether an inflow port of the cooling chamber has an ice nucleus; and
controlling a cooling temperature of solution in the cooling chamber in accordance with whether there is the ice nucleus.

* * * * *